US007223178B2

(12) United States Patent
Henry

(10) Patent No.: US 7,223,178 B2
(45) **Date of Patent: *May 29, 2007**

(54) GOLF BALL PUTTER INCLUDING GOLF BALL ALIGNMENT INDICIA

(75) Inventor: David Vincent Henry, Seymour, TN (US)

(73) Assignee: MPH Golf, LLC, Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/100,660

(22) Filed: Apr. 7, 2005

(65) Prior Publication Data

US 2005/0176520 A1 Aug. 11, 2005

Related U.S. Application Data

(63) Continuation-in-part of application No. 10/713,945, filed on Nov. 14, 2003, now Pat. No. 6,878,072.

(51) Int. Cl.
*A63B 53/04* (2006.01)
*A63B 47/02* (2006.01)

(52) U.S. Cl. ..... 473/252; 473/254; 473/282; 473/286; 473/340; 294/19.2

(58) Field of Classification Search ..... 473/251–255, 473/340–341, 313, 282, 286
See application file for complete search history.

(56) References Cited

U.S. PATENT DOCUMENTS 1,960,110 A 5/1934 Iles
2,465,124 A 3/1949 Quattrin
3,300,241 A 1/1967 Eberwein et al.
3,333,854 A * 8/1967 White ..... 473/288
3,374,027 A 3/1968 Jacobs
3,632,112 A 1/1972 Jacobs
3,708,172 A 1/1973 Rango
3,841,639 A 10/1974 Werner
3,954,265 A * 5/1976 Taylor ..... 473/252
D240,751 S * 7/1976 Taylor ..... D21/734
D257,869 S * 1/1981 MacDougall ..... D21/739
4,248,430 A 2/1981 Kepler
4,580,784 A 4/1986 Brill
4,762,324 A * 8/1988 Anderson ..... 473/249
4,934,702 A 6/1990 Serizawa
4,976,436 A 12/1990 Serizawa
5,102,139 A 4/1992 Greig
5,324,031 A * 6/1994 Green ..... 473/252
5,368,302 A 11/1994 Thomas (Continued)

*Primary Examiner*—Stephen Blau
(74) *Attorney, Agent, or Firm*—Pitts & Brittian, PC

(57) ABSTRACT

A golf putter, ball retriever and retainer configured to retrieve and hold a golf ball. The putter defines a substantially symmetrical configuration from heel to toe. The ball retriever and retainer is defined by a spherical recess formed in the sole of the putter and an opening defined on the top surface thereof. At least one resilient tab is defined in the sole to enlarge the sole opening. Ball alignment indicia are disposed on the top surface of the golf putter head, the ball alignment indicia defining at least a C-shaped configuration, whereby a ball is visually aligned between said first and second ends to center the ball on said striking face. The ball alignment indicia may further include at least one line segment disposed coincidentally to the initial direction of travel of the golf ball.

10 Claims, 5 Drawing Sheets

U.S. PATENT DOCUMENTS

| | | | | |
|---|---|---|---|---|
| 5,417,426 | A | 5/1995 | Bayer | |
| D364,666 | S | 11/1995 | Nagy | |
| 5,485,999 | A | 1/1996 | Hull et al. | |
| 5,524,889 | A | 6/1996 | Rush | |
| 5,544,879 | A * | 8/1996 | Collins | 473/314 |
| 5,628,696 | A | 5/1997 | Frye | |
| 5,692,968 | A | 12/1997 | Shine | |
| D388,853 | S | 1/1998 | Minami | |
| D402,724 | S | 12/1998 | Minami | |
| D424,145 | S | 5/2000 | Minami | |
| 6,322,457 | B1 | 11/2001 | Klein | |
| 6,350,208 | B1 * | 2/2002 | Ford | 473/249 |
| 6,409,610 | B1 * | 6/2002 | Ahn et al. | 473/249 |
| 6,435,975 | B2 | 8/2002 | Middleton | |
| 6,478,688 | B1 * | 11/2002 | Fukui | 473/251 |
| 6,605,008 | B1 * | 8/2003 | Kovarik | 473/329 |
| 2002/0169030 | A1 | 11/2002 | Chun-Sheng | |
| 2003/0008724 | A1 | 1/2003 | Griffin | |
| 2003/0220150 | A1 * | 11/2003 | Takase | 473/251 |

* cited by examiner

GOLF BALL PUTTER INCLUDING GOLF BALL ALIGNMENT INDICIA

CROSS-REFERENCE TO RELATED APPLICATIONS

This is a continuation-in-part of application Ser. No. 10/713,945, filed Nov. 14, 2003 now U.S. Pat. No. 6,878,072.

STATEMENT REGARDING FEDERALLY SPONSORED RESEARCH OR DEVELOPMENT

Not Applicable

BACKGROUND OF THE INVENTION

1. Field of Invention

The present invention pertains to the field of golf putters. More particularly, this invention is a golf ball putter head having golf ball alignment indicia for assisting a golfer in aligning the golf ball with respect to the putter head prior to putting.

2. Description of the Related Art

In the field of golf, it is desirous for several reasons to be able to retrieve a golf ball without bending over. Once a ball has been hit into a cup, it is also desirous to remain as far away from the cup as possible in order to cause minimal disturbance to the green immediately around the cup. This is, for one reason, to maintain the green for golfers to follow. It is also desirous in certain circumstances to retrieve a ball from the green surface, from a deep rough, from a water hazard, or from other locations where bending to retrieve the ball may be difficult.

In any of these situations, the golfer may have a physical disability, injury, or other limitation that prohibits—or at least makes difficult—bending over to pick up the ball. Such golfers are limited in their ability to play in that they may require another golfer or a caddy to retrieve their ball, or they may be prohibited from playing altogether.

Similar situations arise for those same golfers when retrieving a golf club or flag stick lying on the ground. It is well known that many golfers carry more than one club when leaving the golf cart and playing toward the green. For example, a ball having a lie in a sand trap requires a sand wedge. However, once the ball is hit onto the green, the golfer will require a putter. Depending on the particular hole, it may also be desirous to carry a pitching wedge. Instead of having to walk back to the cart to exchange clubs, the golfer will often take both clubs and lay down whichever club(s) not in use.

It is also common to remove the flag stick from the hole and lay it on the ground away from the hole once the hole is in the golfer's sight when addressing the golf ball for a putt. Golfers with physical disabilities or limitations often find it difficult to bend to retrieve golf clubs and flag sticks that are lying on the ground.

Several combined putters and golf ball retrievers and/or holders have been provided in the prior art. Typical of the art are those devices disclosed in the following U.S. patents and published applications:

| Patent No. | Inventor(s) | Issue Date |
|---|---|---|
| D257,869 | A. S. O. MacDougall | Jan. 13, 1981 |
| D364,666 | E. Nagy | Nov. 28, 1995 |
| D388,853 | R. W. Minami | Jan. 6, 1998 |
| D402,724 | R. W. Minami | Dec. 15, 1998 |
| D424,145 | R. W. Minami | May 2, 2000 |
| 1,960,110 | A. S. Iles | May 22, 1934 |
| 2,465,124 | S. Quattrin | Mar. 22, 1949 |
| 3,300,241 | F. D. Eberwein et al. | Jan. 24, 1967 |
| 3,374,027 | C. D. Jacobs | Mar. 19, 1968 |
| 3,632,112 | C. D. Jacobs | Jan. 4, 1972 |
| 3,708,172 | J. F. Rango | Jan. 2, 1973 |
| 3,841,639 | F. D. Werner | Oct. 15, 1974 |
| 4,248,430 | D. L. Kepler | Feb. 3, 1981 |
| 4,580,784 | E. F. Brill | Apr. 8, 1986 |
| 4,934,702 | S. Serizawa | Jun. 19, 1990 |
| 4,976,436 | S. Serizawa | Dec. 11, 1990 |
| 5,102,139 | R. S. Greig | Apr. 7, 1992 |
| 5,368,302 | F. L. Thomas | Nov. 29, 1994 |
| 5,417,426 | S. L. Bayer | May 23, 1995 |
| 5,485,999 | H. L. Hull et al. | Jan. 23, 1996 |
| 5,524,889 | R. Rush | Jun. 11, 1996 |
| 5,628,696 | J. E. Frye | May 13, 1997 |
| 5,692,968 | R. S. Shine | Dec. 2, 1997 |
| 6,332,457 | R. A. Klein | Nov. 27, 2001 |
| 6,435,975 | N. M. Middleton | Aug. 20, 2002 |

| Publication No. | Inventor(s) | Publication Date |
|---|---|---|
| 2002/0169030 | C. Chun-Sheng | Nov. 14, 2002 |
| 2003/0008724 | R. E. Griffin | Jan. 9, 2003 |

Of these patents, the '869 design patent issued to MacDougall illustrates a golf club head defining planar parallel top and bottom surfaces. A cylindrical opening is vertically oriented and centrally disposed in the club head. There is no disclosure as to the function of the opening. The club head defines a planar face and a semicircular trailing edge.

Similarly, the '666 design patent issued to Nagy defines a triangular club head having a centrally disposed opening. However, Nagy illustrates a curved bottom surface. Further, the centrally disposed opening defines a substantially hemispherical configuration. Like the MacDougall club head discussed above, there is no disclosure as to the function of this opening.

Minami ('853 design, '724 design and '145 design) discloses several golf putter heads configured to retrieve a golf ball. Each club head defines a through opening defining a substantially cylindrical side wall through which the golf ball is received.

The '110 patent issued to Iles discloses a golf club having an opening in the sole of the head for retrieving a golf ball. A flexible annular disc is disposed in the opening such that as the club head is forced down over a ball, the disk is deformed to allow the ball to pass through. After the ball passes through the annular disc, the disc returns to its original shape and holds the ball above the opening. There is no disclosure as to whether the ball is retained once received above the annular disc.

S. Quattrin, in the '124 patent, discloses a club similar to a golf club designed to retain a ball such as a golf ball. The '124 club is designed to release the ball at a certain point of a swing so that the ball is thrown from the club head in the direction of the swing. The '124 club is disclosed as being useful in practicing the user's golf swing. There is no disclosure for retrieving an d retaining a golf ball.

The '241 device disclosed by Eberwein et al., is a golf ball retrieving device having two oppositely disposed striking surfaces. A dome shaped pocket is defined in the bottom surface of the head for partially receiving a golf ball therein. A compression spring is provided to retain the golf ball when received in the pocket. The ball is removed by applying tangential pressure on the golf ball.

In his '639 patent, Werner discloses a golf ball retrieving club similar to that of the '241 device disclosed by Eberwein et al. However, in lieu of a compression spring, Werner incorporates a flexible tubular member for retaining a golf ball in a golf ball receptacle.

The '027 golf ball retrieving club disclosed by Jacobs includes a golf ball holding cavity. The golf ball holding cavity defines rigid walls spaced apart a distance to slightly compress a golf ball inserted therein. The cavity is elongated such that a ball retained therein is removed by rolling to ball toward an end thereof. Thomas ('302) discloses a golf putter including ball retrieving device similar to that disclosed by Jacobs ('027).

In his '112 patent, Jacobs discloses a golf ball retrieving club defining a gall ball holding cavity extending completely through the putter head and further opening on the rear wall of the club head. The wall of the cavity is tapered inward from the bottom to the top to compress a golf ball when received therein.

Rango, in his '172 patent, discloses a golf putter having a generally vertically extending opening having a circular cross section extending entirely through the head. The hole is dimensioned to match or be slightly greater than the diameter of a golf ball and is provided for dividing the head into substantially equal masses in order to counterbalance tendencies of the head to twist when the ball is struck at a location other than the center of the head. The hole is further provided to serve as a gauge for measuring the diameter of a ball, and to detect the roundness of a ball. Middleton ('975) discloses a golf club similar to that disclosed by Rango ('172).

Kepler ('430) discloses a golf putter including a club body and a shaft connected to the club body. The club body includes a rear golf ball retrieval-retainer structure which includes at least one hook-shaped arm extending from a lower rear side of the club body. The hook-shaped arm lies in the phantom extension of the lower surface plane passing through the lower surface of the club body. The retrieval-retainer structure is used by sliding the hooked-shaped arm(s) under the golf ball and then lifting. The golf ball then rests on top of the hook-shaped arm(s). Brill ('784) and Shine ('968) disclose devices similar to that of Kepler.

Serizawa, in his '702 and '436 patents, discloses a putter for enabling picking up a ball within a hole in a standing posture. The putter head defines a circular hollow portion adapted to receive a golf ball by pushing the club downward on the ball. The elasticity of the surface of the ball and the friction between the ball and an inner peripheral edge of the circular hollow portion of the head abutting the elastic surface of the ball serve to retain the ball.

Greig ('139) discloses a golf putter provided with means for enabling a ball to be lifted and replaced while the golfer remains in an upright posture. The putter head includes a pair of resilient tangs extending therefrom. The tangs have a spacing slightly smaller than the diameter of the ball and have convergent ends. The tangs are traveled down along opposite sides of the ball to a position below the center of the ball in order to grip the ball for lifting. To replace the ball on the ground, the putter is engaged with the ground, with the ball positioned at a desired location. The golfer uses his/her foot to engage the ball such that when the putter is lifted, the ball becomes disengaged from the tangs.

In the '426 patent, Bayer discloses a golf putter having ball retrieval and ball marking features. The '426 putter defines a through opening having a side wall tapering in from the bottom to a distance above the bottom, then tapering out from to the top. A reduced diameter is defined at the point the taper changes direction. A ball may be passed through the reduced diameter and received in the upper portion of the opening.

Hull et al., ('999) disclose a golf putter including a golf ball retriever and ejection system. A recess is defined in the lower surface of the club head for receiving a portion of a golf ball. A rubber ring is provided at the opening to retain the ball in the recess. An ejection means including a plunger is provided in the top of the club head. When a ball is received in the recess, the plunger is extended above the club head. The ball is then ejected from the recess by pushing on the plunger.

Rush ('889) discloses another putter having a ball receiver. The '889 device defines an opening for receiving a golf ball. The wall of the opening is described as either defining a tapered arrangement similar to Bayer ('426) described above, or including a rubber gasket as disclosed by Hull et al. ('999). A retaining element is carried by the top of the club head for retaining the ball after being received through the opening. To remove the ball from the club head, the ball is forced back through the opening.

Frye ('696) discloses a golf putter having a ball retrieval device configured similarly to that disclosed by Nagy ('666 design). However, Frye does not disclose an opening in the top of the club head. Frye teaches, on the contrary, that the ball is received and held in the ball retrieval device by applying the weight of the golf club on the ball, the ball being held by friction.

Finally, Klein ('457) discloses a golf putter head with a cutout for engaging and retrieving a golf ball. The cutout extends perpendicularly through both the front face surface and the rear surface of the putter head and has an upper surface and a pair of flat, opposing walls that terminate in lower edges to form an opening for receiving a golf ball into the cutout. The cutout walls are tapered toward each other at their upper edges to form a self-holding taper for engaging the golf ball. The cutout is positioned in the heel section of the putter head so that the cutout opens vertically through the sole of the putter head, or horizontally through the heel of the putter head, or at any angle between the vertical and the horizontal.

BRIEF SUMMARY OF THE INVENTION

The present invention is a golf putter head, ball retriever and retainer. The putter is configured to assist the golfer in accurately swinging through a putt. After the ball has been successfully hit into a cup or otherwise when the ball is to be retrieved, the ball retriever and retainer is employed in such a manner as to not require the golfer to bend or stoop. Further, the putter is configured to retrieve another golf club and/or a flag stick lying on the ground. The combined golf putter head, ball retriever and retainer, and golf club and flag stick retriever is fabricated in a one-piece construction.

The putter defines a substantially symmetrical configuration such that the weight from heel to toe is symmetrical. The ball retriever and retainer is centered with respect to the striking face of the putter. A shaft retriever is defined proximate the trailing edge of top surface of the putter. The shaft retriever is provided for retrieving elongated objects such as a golf club or flag stick that is lying on the ground. Ball alignment indicia are carried on the top surface of the putter. The ball alignment indicia include a substantially C-shaped indicium used for centering the ball with respect to the striking face of the putter and for aligning the putter with the initial direction of travel of the golf ball once struck. In an alternate embodiment, the ball alignment indicia further includes at least one line segment disposed orthogonally to the striking face, and coincident with the initial direction of travel of the golf ball once struck.

The ball retriever and retainer is defined by a spherical recess formed in the sole of the putter and an opening defined on the top surface thereof. The opening defined in the top surface of the putter is provided for engaging a golf ball received within the ball retriever and retainer in order to push the golf ball out of engagement therein. The spherical recess is further defined by an opening on the sole of the putter, the sole opening defining a diameter slightly less than the diameter of a conventional golf ball. In order to receive a golf ball into the ball retriever and retainer, at least one resilient tab is defined in the sole to enlarge the sole opening. A raised portion is defined at the distal end of each of the tabs to provide additional restraint from the golf ball being removed from within the spherical recess. When a golf ball is received within the ball retriever and retainer, the tabs are returned to their initial, natural disposition so that if the ball is left in place for an extended period of time, the putter is not permanently deformed as a result of flexion. Further, the ball is not damaged as a result of continuous compression.

The putter defines a curved transition from the sole of the putter to the trailing edge to assist in placing putter in the cup. If the putter engages the lip of the cup, the curved transition guides the putter over the edge of the cup, thereby preventing damage to either or both of the putter and the green immediately surrounding the cup and under the putter. The curved transition further serves to reduce drag in rough or fringe areas, and reduces stubbing through a golfer's back swing. The sole defines an angle of approximately 7° such that the bottom is relatively flat at the natural extension of the golfer's forearm.

The ball retriever and retainer is positioned in the putter relative to the striking face such that the ball retriever and retainer is substantially centered over a golf ball when placed in conventional cup. When the putter is inserted into a cup to retrieve a golf ball, the golf ball is easily engaged within the ball retriever and retainer. The trailing edge defines a radius less than the radius of a conventional cup so that the putter is readily received within the cup.

The top surface of the putter defines a shaft retriever proximate the trailing edge for engaging a golf club shaft or flag stick for lifting the same from the ground. The shaft retriever is a longitudinal groove disposed parallel to the striking surface. The shaft retriever defines a distal end adapted to be received under the exemplary devices having a shaft or staff.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
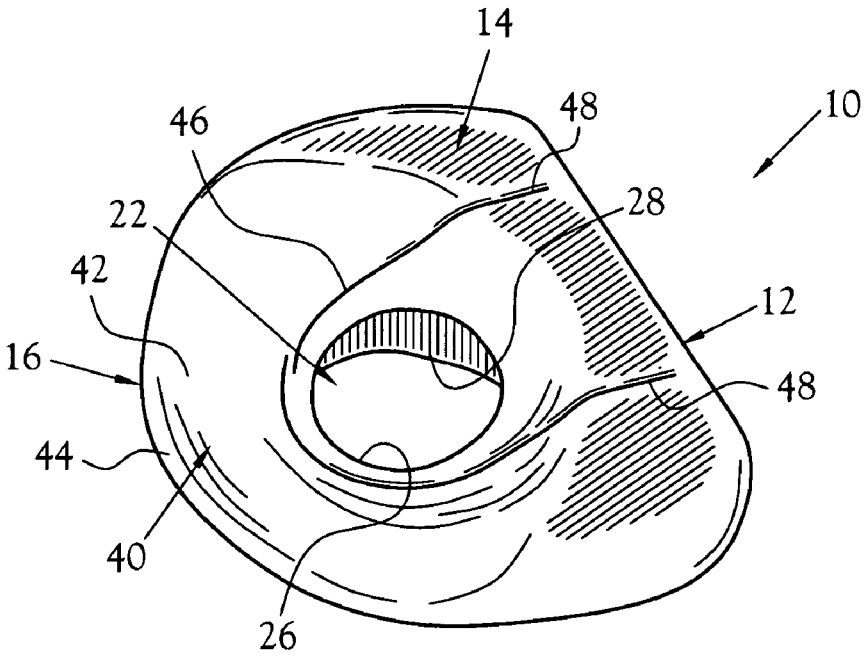
FIG. 1 is a perspective view of a golf putter head, ball retriever and retainer showing various features of the present invention.

A golf putter head, ball retriever and retainer is disclosed. The golf putter head is illustrated at 10 in figures. The golf putter head, or putter 10, defines the ball retriever and retainer 22 as will be described below. The putter 10 is configured to assist the golfer in accurately swinging through a putt. After the ball 50 has been successfully hit into a cup 52, or otherwise when the ball 50 is to be retrieved, the ball retriever and retainer 22 is employed in such a manner as to not require the golfer to bend or stoop. Further, the putter 10 is configured to retrieve another golf club and/or a flag 56 lying on the ground. The putter 10 defines a one-piece construction, thereby requiring no assembly, and minimizing potential for failure.

Figure 2:
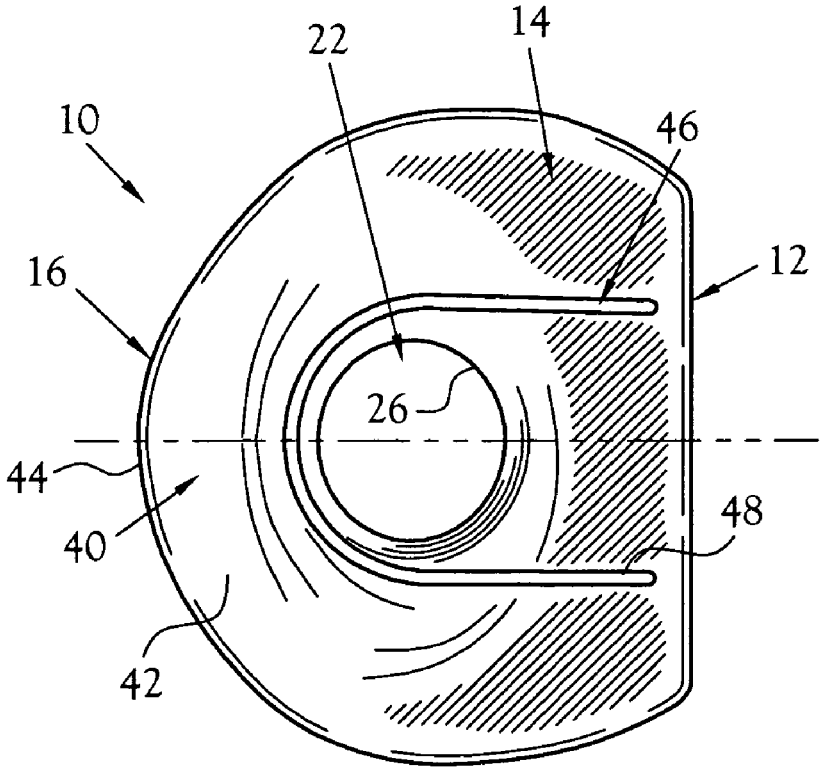
FIG. 2 is a top plan view of the golf putter head, ball retriever and retainer of FIG. 1.

Several features of the putter 10 of the present invention are illustrated in the perspective view of FIG. 1, and more clearly in FIG. 2. The putter 10 defines a substantially symmetrical configuration such that the weight from heel to toe is symmetrical. The ball retriever and retainer 22 is centered with respect to the striking face 12 of the putter 10. The ball retriever and retainer 22 defines an opening 26 through the top surface 14 of the putter 10 as will be described in greater detail below. Because the putter 10 is symmetrical, a club shaft 56 may be secured to the putter 10 at selected locations to use the putter 10 for both left- and right-handed golfers.

A golf club shaft and flag staff retriever 40, or shaft retriever 40, is defined proximate the trailing edge 16 of top surface 14 of the putter 10. As will be described in greater detail below, the shaft retriever 40 is provided for retrieving elongated objects 56 such as a golf club or flag that is lying on the ground.

Ball alignment indicia 46 are carried on the top surface 14 of the putter 10. The ball alignment indicia 46 defines a C-shaped configuration terminating at each end 48 proximate the striking face 12 and extending around the ball retriever and retainer top surface opening 26. The ball 50 is visually aligned between the two ends 48 of the ball alignment indicia 46 to accomplish maximum control through a stroke. As best illustrated in FIG. 1, when the golfer is looking at the putter 10 at an angle other than directly from above, the indicia 46 appear as distorted lines. However, once the golfer views the putter 10 from directly above, the indicia 46 appear as straight lines, as best illustrated in FIG. 2. Thus, the indicia 46 further serves to indicate when the golfer is positioned directly above the putter 10.

Figure 1A:
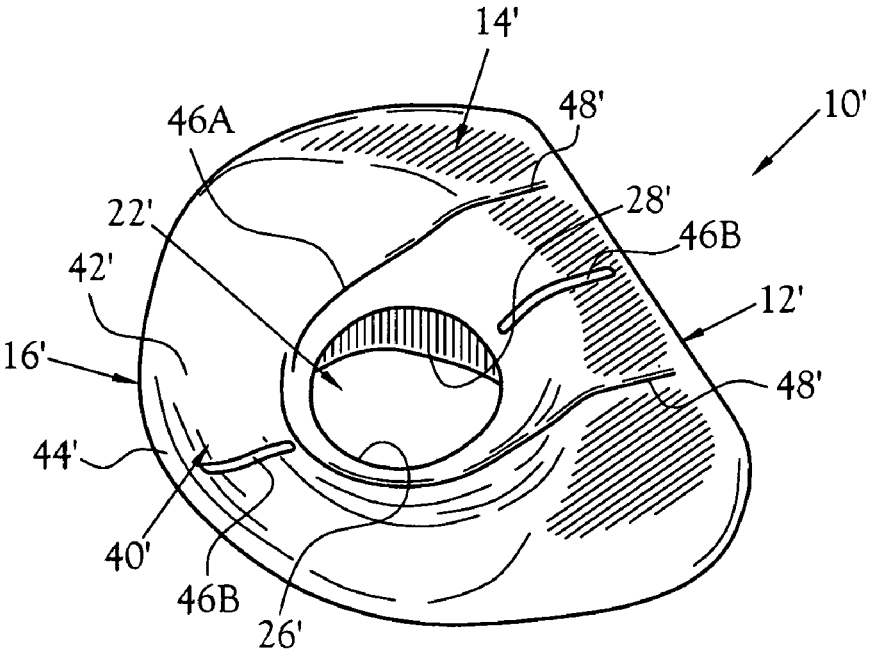
FIG. 1A is a perspective view of an alternate embodiment of the golf putter head, ball retriever and retainer showing various features of the present invention.
Figure 2A:
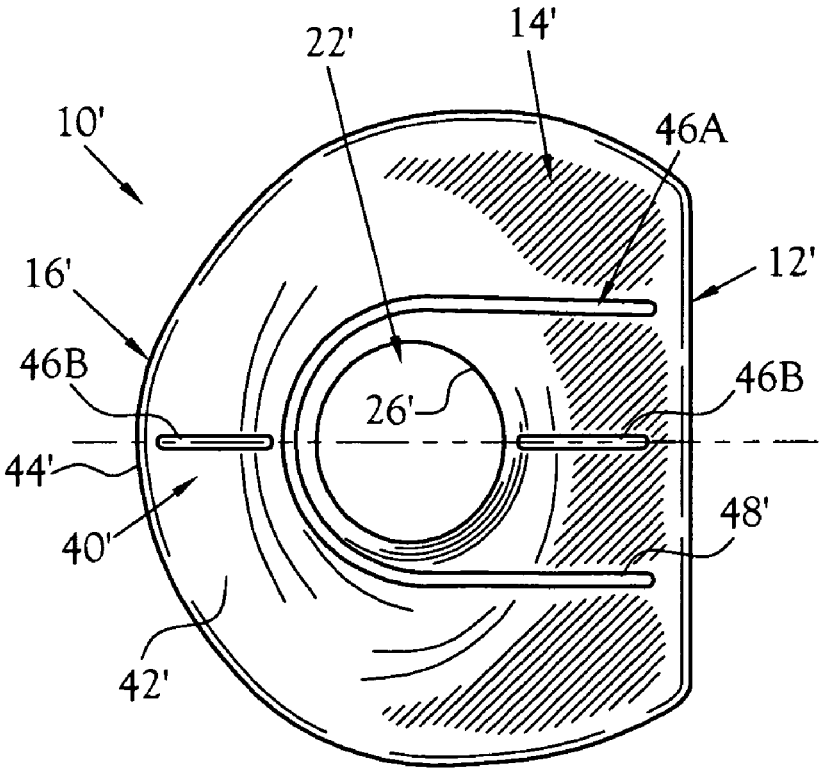
FIG. 2A is a top plan view of the alternate embodiment of the golf putter head, ball retriever and retainer of FIG. 1A.

Illustrated in FIGS. 1A and 2A is an alternate embodiment of the putter 10' of the present invention. In this embodiment, the ball alignment indicia 46' includes the C-shaped indicia 46A, and further includes at least one line segment 46B disposed orthogonally to the striking face 12', and coincident with the initial direction of travel of the golf ball once struck. A line (illustrated in FIG. 2A as a centerline) drawn through each line segment 46B bisects the C-shaped indicia 46A. As illustrated, the C-shaped indicia assists the golfer in centering a golf ball along the striking face 12', while the line segments 46B assist in aligning the striking face 12' orthogonally with respect to the initial direction of travel of the golf ball.

In the illustrated embodiment, a first line segment 46B is disposed between the striking face 12' and the opening 26'. A second line segment 46B is disposed between the opening 26' and the trailing edge 16' of the putter 10'. While illustrated, the opening 26' is not required for the functions of the indicia 46'. However, the ball retriever and retainer top surface opening 26' serves further as indicia to assist in the alignment of the ball and the putter 10'. As in the previous embodiment, when the golfer is looking at the putter 10' at an angle other than directly from above, the indicia 46' appear as distorted lines. However, once the golfer views the putter 10' from directly above, the indicia 46' appear as straight lines, as best illustrated in FIG. 2A. Thus, the indicia 46 further serves to indicate when the golfer is positioned directly above the putter 10.

Figure 3:
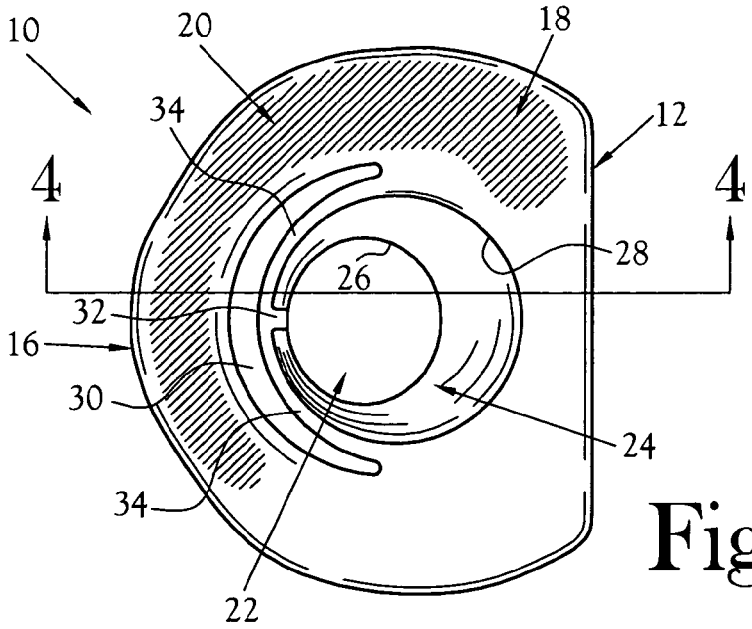
FIG. 3 is a bottom plan view of the golf putter head, ball retriever and retainer of FIG. 1, further illustrating the ball retriever and retainer.
Figure 4:
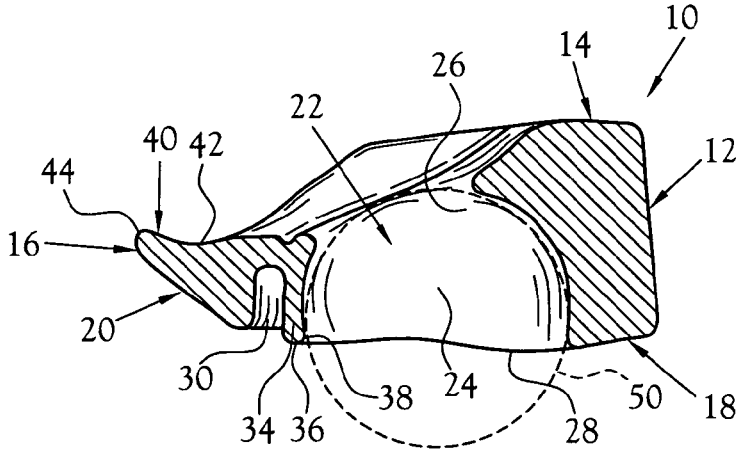
FIG. 4 is a side elevation view, in section, of the golf putter head, ball retriever and retainer, taken at 4—4 of FIG. 3.

As better illustrated in FIGS. 3 and 4, the ball retriever and retainer 22 is defined by a spherical recess 24 formed in the sole 18 of the putter 10 and an opening 26 defined on the top surface 14 thereof. The opening 26 defined in the top surface 14 of the putter 10 is provided for engaging a golf ball 50 received within the ball retriever and retainer 22 in order to push the golf ball 50 out of engagement therein. The spherical recess 24 is further defined by an opening 28 on the sole 18 of the putter 10, the sole opening 28 defining a diameter slightly less than the diameter of a conventional golf ball 50. In order to receive a golf ball 50 into the ball retriever and retainer 22, at least one resilient tab 34 is defined in the sole 18 to enlarge the sole opening 28. In the illustrated embodiment, the sole 18 defines an arcuate recess 30 concentric with the sole opening 28. A notch 32 is defined between the bisector of the arcuate recess 30 and the sole opening 28. As a result, two resilient tabs 34 are defined between the arcuate recess 30, the sole opening 28, and the notch 32. As a golf ball 50 is received into the ball retriever and retainer 22, the tabs 34 are flexed to enlarge the sole opening 28. After the equator of the golf ball 50 has been received through the sole opening 28, the tabs 54 return to their initial position, thereby retaining the golf ball 50 within the spherical recess 24.

In the illustrated embodiment, a raised portion 38 is defined at the distal end 36 of each of the tabs 54. The raised portion 38 extends toward the center of the spherical recess 24 to provide additional restraint from the golf ball 50 being removed from within the spherical recess 24.

As illustrated best in FIG. 4, when a golf ball 50 is received within the ball retriever and retainer 22, the tabs 54 are returned to their initial, natural disposition so that if the ball 50 is left in place for an extended period of time, the putter 10 is not permanently deformed as a result of flexion. Further, the golf ball 50 is not permanently deformed as a result of compression. For example, at the end of a round, one may leave the golf ball 50 in the ball retriever and retainer 22 and then place the putter 10 in the trunk of an automobile. In that case, even if the putter 10 is subjected to extreme and prolonged conditions, the golf ball 50 will not cause the putter 10 to be permanently deformed.

Figure 5:
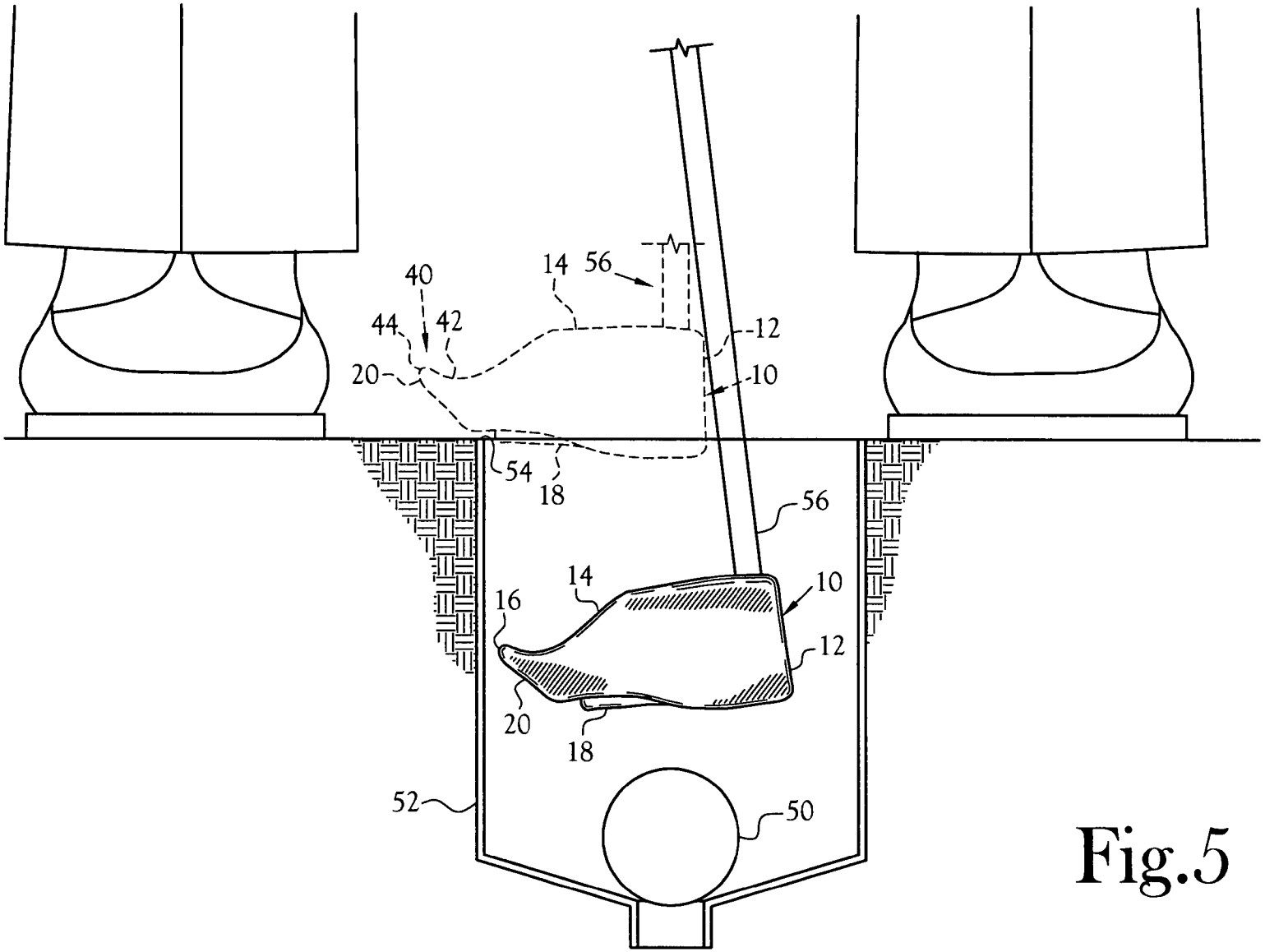
FIG. 5 is a side elevation of the golf putter head, ball retriever and retainer of FIG. 1 illustrating the curved transition on the trailing edge assisting in the insertion of the golf putter into the hole in the instance where the trailing edge of the putter engages the lip of the cup.

As illustrated in FIG. 5, the putter 10 defines a curved transition 20 from the sole 18 of the putter 10 to the trailing edge 16 to assist in placing putter 10 in the cup 52. As illustrated in phantom, if the putter 10 engages the lip 54 of the cup 52, the curved transition 20 guides the putter 10 over the lip 54 of the cup 52, thus preventing damage to the putter 10 and the green immediately surrounding the cup 52 and under the putter 10. The curved transition 20 further serves to reduce drag in rough or fringe areas, and reduces stubbing through a golfer's back swing.

Figure 7:
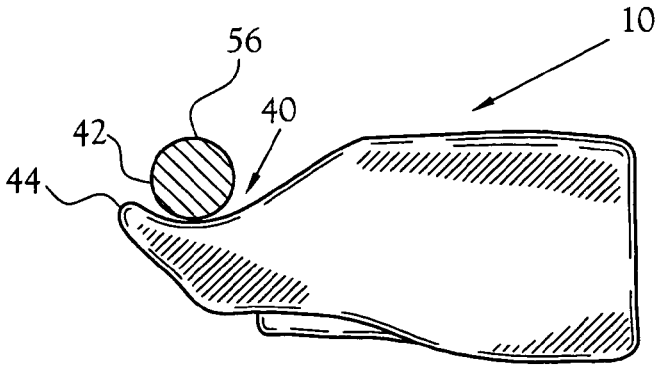
FIG. 7 is a side elevation of the golf putter head, ball retriever and retainer of FIG. 1 showing the shaft retriever engaging an elongated object such as a golf club shaft or a flag stick.

As illustrated in FIGS. 5 and 7, the sole 18 defines an angle of approximately 7° such that the bottom is relatively flat at the natural extension of the golfer's forearm. This is especially the situation when the golfer extends the putter 10 between his/her feet and into the cup 52 to retrieve the golf ball 50. For a right-handed golfer, the golfer may use his/her right arm to retrieve the golf ball 50 while naturally extending the right arm and maintaining the sole 18 of the putter 10 in a substantially horizontally orientation.

Figure 6:
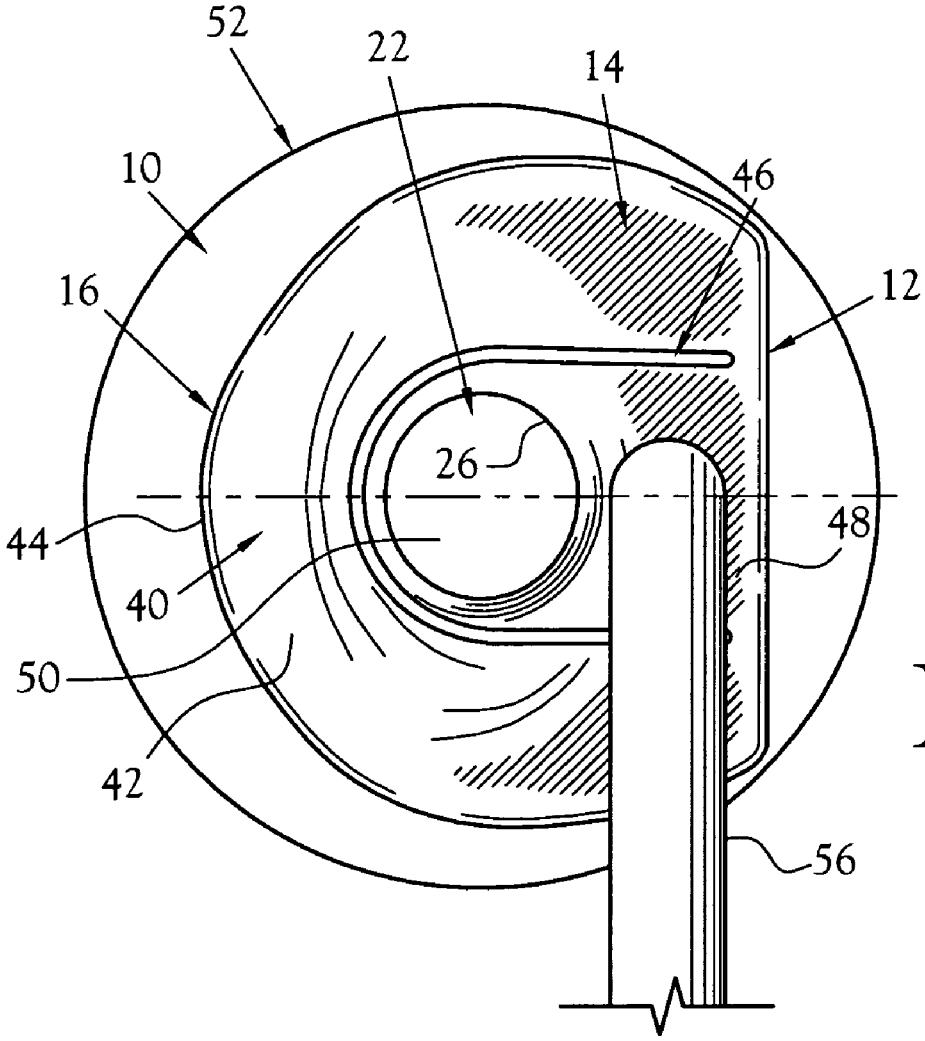
FIG. 6 is a top plan view of the golf putter head, ball retriever and retainer of FIG. 1 showing the leading edge of the golf putter head assisting in the centering of the putter as it is inserted in a conventional cup and over a golf ball received therein.

Referring to FIG. 6, the ball retriever and retainer 22 is positioned in the putter 10 relative to the striking face 12 such that the ball retriever and retainer 22 is substantially centered over a golf ball 50 when placed in conventional cup 52. As a result, when the putter 10 is inserted into a cup 52 to retrieve a golf ball 50, the golf ball 50 is easily engaged within the ball retriever and retainer 22. To this extent, the trailing edge 16 defines a radius less than the radius of a conventional cup 52 so that the putter 10 is readily received within the cup 52.

Referring specifically to FIG. 7, the top surface 14 of the putter 10 defines a shaft retriever 40 proximate the trailing edge 16 for engaging a golf club shaft or flag stick 56 for lifting the same from the ground. The shaft retriever 40 is a longitudinal groove 42 disposed parallel to the striking surface 12. The shaft retriever 40 defines a distal end 44 adapted to be received under the exemplary devices 56 having a shaft or staff.

It will be noted that the composition used to fabricate the putter 10 may be altered to vary the weight of the putter 10 for varied conditions. For example, heavier putters 10 may be more desirable when the speed of the green is slower, whereas, in conditions where a golf ball 50 travels more rapidly across a green, a lighter weight putter 10 is desirable.

From the foregoing description, it will be recognized by those skilled in the art that a golf putter head having an integral ball retriever and retainer has been provided. The putter is configured to assist the golfer in accurately swinging through a putt, while also providing a means for retrieving and holding a golf ball in a manner wherein neither the golf ball nor the putter is harmed due to flexion in the putter and compression of the golf ball. The ball retriever and retainer is employed in such a manner as to not require the golfer to bend or stoop. The putter is further useful for retrieving another golf club and/or a flag lying on the ground.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. A golf putter head comprising:

a striking face defining a planar surface and defining an orthogonal bisector;

a trailing edge;

a sole;

a top surface;

ball alignment indicia disposed on said top surface of said golf putter head, said ball alignment indicia defining:

a centering indicia defining C-shaped configuration terminating at first and second ends proximate said striking face, said first end defining a first centering indicia line segment, said second end defining a second centering indicia line segment, said first end and said second end being disposed substantially parallel with respect to each other and substantially orthogonal with respect to said striking face, whereby a ball is visually aligned between said first and second ends to center the ball on said striking face; and at least one line segment defined on said orthogonal bisector, whereby the ball is visually aligned along said at least one line segment with said at least one line segment being oriented along a line of initial travel of the golf ball after being struck, said at least one line segment including a first line segment terminating proximate said striking face and a second line segment terminating proximate said trailing edge;

a through opening defined in a center of said golf putter head for receiving and retaining a golf ball, said centering indicia extending around said through opening, said first line segment being defined between said striking face and said through opening, and said second line segment being defined between said through opening and said trailing edge, said through opening defining a spherical recess formed in said golf putter head between said sole and said striking surface, said sole defining an opening adapted to be slightly smaller than the diameter of a golf ball, said top surface defining an opening to reveal a portion of the golf ball when received within said spherical recess, said top surface opening being provided for engaging the golf ball when received within said spherical recess to push the golf ball out of said spherical recess; and a retainer for retaining the golf ball within said spherical recess, said retainer including a plurality of resilient tabs defined in said sole proximate said sole opening to enlarge said sole opening to receive the golf ball, whereby each of said plurality of resilient tabs returns to an initial unflexed state upon receipt of the golf ball, said plurality of resilient tabs being defined between an arcuate recess and said sole opening, said arcuate recess being concentrically disposed with respect to said sole opening, at least one notch being defined between said arcuate recess and said sole opening to define said plurality of resilient tabs.

2. The golf putter head of claim 1 wherein said top surface defines a non-planar configuration whereby said ball alignment indicia appear distorted when viewed at a non-perpendicular angle with respect to said top surface.

3. The golf putter head of claim 1 wherein a distal end of each of said plurality of resilient tabs defines a raised portion extending toward a center of said spherical recess, said raised portion enhancing restraint of the golf ball within said spherical recess.

4. A golf putter head comprising:

a striking face defining a planar surface and defining an orthogonal bisector;

a trailing edge;

a sole;

a top surface, said top surface defining a non-planar configuration; and ball alignment indicia disposed on said top surface of said golf putter head, said ball alignment indicia appearing distorted when viewed at a non-perpendicular angle with respect to said top surface, said ball alignment indicia defining:

a centering indicia defining C-shaped configuration terminating at first and second ends proximate said striking face, said first end defining a first centering indicia line segment, said second end defining a second centering indicia line segment, said first end and said second end being disposed substantially parallel with respect to each other and substantially orthogonal with respect to said striking face, whereby a ball is visually aligned between said first and second ends to center the ball on said striking face;

a first line segment terminating proximate said striking face;

a second line segment terminating proximate said trailing, whereby the ball is visually aligned along said first and second line segments with said first and second line segments being oriented along a line of initial travel of the golf ball after being struck;

a through opening defined in a center of said golf putter head for receiving and retaining a golf ball, said centering indicia extending around said through opening, said first line segment being defined between said striking face and said through opening, and said second line segment being defined between said through opening and said trailing edge, said through opening defining a spherical recess formed in said golf putter head between said sole and said striking surface, said sole defining an opening adapted to be slightly smaller than the diameter of a golf ball, said top surface defining an opening to reveal a portion of the golf ball when received within said spherical recess, said top surface opening being provided for engaging the golf ball when received within said spherical recess to push the golf ball out of said spherical recess; and a retainer for retaining the golf ball within said spherical recess, said retainer including a plurality of resilient tabs defined in said sole proximate said sole opening to enlarge said sole opening to receive the golf ball, whereby each of said plurality of resilient tabs returns to an initial unflexed state upon receipt of the golf ball, said plurality of resilient tabs being defined between an arcuate recess and said sole opening, said arcuate recess being concentrically disposed with respect to said sole opening, at least one notch being defined between said arcuate recess and said sole opening to define said plurality of resilient tabs.

5. The golf putter head of claim 4 wherein a distal end of each of said plurality of resilient tabs defines a raised portion extending toward a center of said spherical recess, said raised portion enhancing restraint of the golf ball within said spherical recess.

6. A golf putter head comprising:

a striking face defining a planar surface and defining an orthogonal bisector;

a trailing edge;

a sole;

a top surface;

ball alignment indicia disposed on said top surface of said golf putter head, said ball alignment indicia defining:

a centering indicia defining C-shaped configuration terminating at first and second ends proximate said striking face, whereby a ball is visually aligned between said first and second ends to center the ball on said striking face; and at least one line segment defined on said orthogonal bisector, whereby the ball is visually aligned along said at least one line segment with said at least one line segment being oriented along a line of initial travel of the golf ball after being struck, said at least one line segment including a first line segment terminating proximate said striking face and a second line segment terminating proximate said trailing edge;

a through opening defined in a center of said golf putter, said centering indicia extending around said through opening, said first line segment being defined between said striking face and said through opening, and said second line segment being defined between said through opening and said trailing edge, wherein said through opening is a ball retriever, said through opening defining a spherical recess formed in said golf putter head between said sole and said striking surface, said sole defining an opening adapted to be slightly smaller than the diameter of a golf ball, said top surface defining an opening to reveal a portion of the golf ball when received within said spherical recess, said top surface opening being provided for engaging the golf ball when received within said spherical recess to push the golf ball out of said spherical recess; and a retainer for retaining the golf ball within said spherical recess, said retainer including a plurality of resilient tabs defined in said sole proximate said sole opening to enlarge said sole opening to receive the golf ball, whereby each of said plurality of resilient tabs returns to an initial unflexed state upon receipt of the golf ball, said plurality of resilient tabs being defined between an arcuate recess and said sole opening, said arcuate recess being concentrically disposed with respect to said sole opening, at least one notch being defined between said arcuate recess and said sole opening to define said plurality of resilient tabs.

7. The golf putter head of claim 6 wherein said top surface defines a non-planar configuration whereby said ball alignment indicia appear distorted when viewed at a non-perpendicular angle with respect to said top surface.

8. The golf putter head of claim 6 wherein a distal end of each of said plurality of resilient tabs defines a raised portion extending toward a center of said spherical recess, said raised portion enhancing restraint of the golf ball within said spherical recess.

9. A golf putter head comprising:

a striking face defining a planar surface and defining an orthogonal bisector;

a trailing edge;

a sole;

a top surface, said top surface defining a non-planar configuration; and ball alignment indicia disposed on said top surface of said golf putter head, said ball alignment indicia appearing distorted when viewed at a non-perpendicular angle with respect to said top surface, said ball alignment indicia defining:

a centering indicia defining C-shaped configuration terminating at first and second ends proximate said striking face, whereby a ball is visually aligned between said first and second ends to center the ball on said striking face;

a first line segment terminating proximate said striking face; and a second line segment terminating proximate said trailing, whereby the ball is visually aligned along said first and second line segments with said first and second line segments being oriented along a line of initial travel of the golf ball after being struck;

a through opening defined in a center of said golf putter, said centering indicia extending around said through opening, said first line segment being defined between said striking face and said through opening, and said second line segment being defined between said through opening and said trailing edge, wherein said through opening is a ball retriever, said through opening defining a spherical recess formed in said golf putter head between said sole and said striking surface, said sole defining an opening adapted to be slightly smaller than the diameter of a golf ball, said top surface defining an opening to reveal a portion of the golf ball when received within said spherical recess, said top surface opening being provided for engaging the golf ball when received within said spherical recess to push the golf ball out of said spherical recess; and a retainer for retaining the golf ball within said spherical recess, said retainer including a plurality of resilient tabs defined in said sole proximate said sole opening to enlarge said sole opening to receive the golf ball, whereby each of said plurality of resilient tabs returns to an initial unflexed state upon receipt of the golf ball, said plurality of resilient tabs being defined between an arcuate recess and said sole opening, said arcuate recess being concentrically disposed with respect to said sole opening, at least one notch being defined between said arcuate recess and said sole opening to define said plurality of resilient tabs.

10. The golf putter head of claim 9 wherein a distal end of each of said plurality of resilient tabs defines a raised portion extending toward a center of said spherical recess, said raised portion enhancing restraint of the golf ball within said spherical recess.

* * * * *